US007070834B2

(12) United States Patent
Kasahara

(10) Patent No.: US 7,070,834 B2
(45) Date of Patent: Jul. 4, 2006

(54) PRODUCTION METHOD OF POROUS MEDIUM

(75) Inventor: Kenzo Kasahara, Hachioji (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 1 day.

(21) Appl. No.: 10/863,568

(22) Filed: Jun. 8, 2004

(65) Prior Publication Data

US 2004/0258845 A1 Dec. 23, 2004

(30) Foreign Application Priority Data

Jun. 17, 2003 (JP) ..... 2003-171962

(51) Int. Cl.
*B05D 3/00* (2006.01)

(52) U.S. Cl. ..... 427/407.1; 427/177; 427/243; 427/384; 427/419.1; 427/419.2; 427/421.1

(58) Field of Classification Search ..... 427/177, 427/179, 209, 243, 245, 372.2, 373, 384, 427/385.5, 387, 393.5, 397.7, 402, 407.1, 427/412.1, 412.5, 419.2, 421
See application file for complete search history.

(56) References Cited

U.S. PATENT DOCUMENTS

| | | | | |
|---|---|---|---|---|
| 6,676,754 | B1 * | 1/2004 | Fleming et al. | 118/325 |
| 6,773,771 | B1 | 8/2004 | Ashida et al. | |
| 2003/0068476 | A1 * | 4/2003 | Yamada et al. | 428/195 |
| 2003/0072923 | A1 * | 4/2003 | Sumioka et al. | 428/195 |

FOREIGN PATENT DOCUMENTS

| | | | |
|---|---|---|---|
| DE | 100 20 346 | A1 | 11/2000 |
| EP | 04 25 3552 | | 5/2001 |
| JP | 09001922 | | 1/1997 |
| JP | 2002240424 | | 8/2002 |
| WO | WO 00/53406 | A | 9/2000 |
| WO | WO 02/00785 | A1 * | 1/2005 |

* cited by examiner

*Primary Examiner*—Timothy Meeks
*Assistant Examiner*—William Phillip Fletcher, III
(74) *Attorney, Agent, or Firm*—Lucas & Mercanti, LLP

(57) ABSTRACT

A production method of a porous medium comprising a non-water-absorptive support and a porous layer provided on the support is disclosed. The method includes steps of, applying Water-based Composition A comprising inorganic microparticles of an average primary particle diameter of less than or equal to 30 nm, a hydrophilic binder and water onto the support to form a coated layer, drying the coated layer to form the porous layer, and applying Water-based Composition B onto the porous layer, and the Water-based Composition A further comprises a compound represented by Formula

19 Claims, No Drawings

PRODUCTION METHOD OF POROUS MEDIUM

BACKGROUND OF THE INVENTION

The present invention relates to a production method of a porous medium and specifically to a production method of a photographic ink jet recording medium.

In recent years, ink jet recording materials have been increasingly improved in image quality which is more and more approaching conventional photographic quality. Specifically, ink jet recording sheets have been improved to meet the need, in order to achieve image quality equivalent to conventional photographic quality employing ink jet recording. As a result, a porous type recording sheet, which comprises a highly smoothed support having thereon an ink receptive layer comprised of pigments and hydrophilic polymers, has become one of the ink jet recording sheets which result in conventional photographic quality due to high glossiness, bright color formation, and excellent ink absorbability as well as excellent ink drying properties. When a non-water absorptive support is employed, cockling (also called wrinkling), which is common for water absorptive supports, does not occur after printing, whereby it is possible to maintain the highly smoothed surface, resulting in higher quality prints. Further, when water-soluble dye ink is employed, it is possible to produce color prints with image quality equivalent to conventional photography which results in clear high-definition and uniform surface glossiness.

Of these ink jet recording materials, particularly a porous medium of a microscopic pore diameter of 20–50 nm has increasingly been used as an ink jet recording sheet from the latter half of the 1990s and has established its own industrial position. Characteristics required for a porous medium as a photographic ink jet recording sheet include: (1) a uniform surface or occasionally a highly glossy surface, (2) rapid absorption of deposited ink droplets, and (3) sufficient color formation. Widely known as ink jet recording sheets exhibiting such characteristics are those which are prepared by coating a liquid coating composition, comprising inorganic microparticles of a microscopic diameter, and hydrophilic binders (refer to, for example, Patent Document 1). During the preparation, it is commonly known that the coating weight of inorganic microparticles is to be at least 10 g/m$^2$, and the weight ratio (F/B) of the inorganic microparticles (F) to the hydrophilic binders (F) is to be 2–20. However, the following are problems. The employed liquid coating composition is very delicate and coagulants tend to result depending on specific additives. The resulting porous layer is fragile, whereby cracking tends to occur due to rough handling during coating and drying, or after drying. These problems markedly occur when inorganic microparticles at an average diameter of the primary particles of less than or equal to 30 nm are specifically employed.

On the other hand, a method is known in which urea or its derivatives are employed as a plasticizer for binders in the porous ink receptive layer which constitutes an ink jet recording sheet. For example, a recording sheet is proposed which comprises a substrate having thereon a porous ink receptive layer comprising at least one compound selected from the group consisting of urea derivatives, semicarbazide derivatives, carbohydrazide derivatives, and hydrazine derivatives and exhibits excellent dye fixability (refer, for example, to Patent Document 2). However, the above patent document refers to neither minimization of cracking during drying due to the presence of urea derivatives nor to desired effects for ink absorbability.

As one measure to overcome the above drawback, it is desired to form a porous layer while avoiding the use of undesirably affecting additives as much as possible, so that generation of coagulants is avoided, while maintaining the stability of the liquid coating composition. However, some additives are essential to realize the various characteristics required for the porous media. Consequently, many of these additives are occasionally incorporated into a porous medium, separately coated after forming the porous layer. In the case of long-run coating, in view of production cost, it is advantageous that after forming a porous layer, for example, the second coating is carried out prior to winding the precedent coating into a roll. Proposed as one of the examples is a method in which after the falling-rate drying zone, a solution comprising functional additives is applied onto the porous layer (refer, for example, to Patent Document 3).

However, in the method in which formation of the porous layer and the addition of functional compounds are separately carried out, the potential of generation of coating problems increases during the second coating, resulting in lowering the resulting yield. Consequently, it is desired that conditions which enable stable coating are selected as much as possible and the employed liquid coating composition exhibits characteristics which minimize such problems. Specifically, in the second coating, is a process in which the liquid coating composition comprising functional additives penetrates into the porous layer formed by the first coating. The inventors of the present invention made verification based on each of the proposed methods described above. As a result, it was discovered that characteristics of the porous layer formed in the first coating greatly affect final coating quality.

(Patent Document 1):

Japanese Patent Publication Open to Public Inspection (hereinafter referred to as JP-A) No. 11-348409 (claims)

(Patent Document 2):

JP-A No. 2001-10211 (Paragraph No. 0020)

(Patent Document 3):

JP-A No. 2002-3317456 (claims)

SUMMARY OF THE INVENTION

An objective of the present invention is to provide a production method of a porous medium with minimal coating problems in the coating process which necessitates at least two-time coating.

The invention and its embodiments are described.

1. A production method of a porous medium comprising a non-water-absorptive support and a porous layer provided on the support, the method comprising, applying Water-based Composition A comprising inorganic microparticles of an average primary particle diameter of less than or equal to 30 nm, a hydrophilic binder and water onto the support to form a layer, drying the layer to form the porous layer, and applying Water-based Composition B onto the porous layer, wherein the Water-based Composition A further comprises a compound represented by Formula (1), Formula (1)

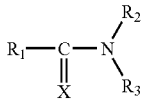

wherein $R_1$, $R_2$ and $R_3$ each represents a hydrogen atom, a substituted or unsubstituted alkyl group, an alkenyl group, an aryl group, an acyl group, a heteroaryl group, a heterocyclic group, —$NR_4R_5$, or —$OR_6$; $R_4$, $R_5$ and $R_6$ each is the same as $R_1$; further, $R_1$ and $R_2$, $R_1$ and $R_3$, and $R_1$ and $R_4$ may be joined together to form a ring; and X represents an oxygen atom or NH.

The compound represented by Formula (1) is preferably soluble in water.

The molecular weight of the compound represented by Formula (1) is preferably less than or equal to 200.

In the Formula (1) X is preferably an oxygen atom.

The preferable example of the compound represented by Formula (1) is urea or its derivative, which is a compound of the Formula 1 in which X is an oxygen atom and $R_1$ is $NR_4R_5$.

The preferable example of the compound represented by Formula (1) is

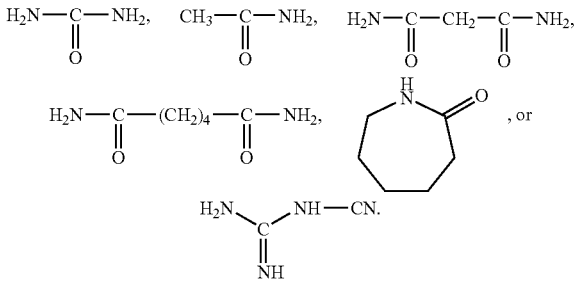

In the method, F/B is preferably 2 to 20, and F is at least 10 g/m$^2$, wherein F is amount of the inorganic microparticles and B is an amount of the binder in the porous layer.

The method preferably further comprises, after applying Water-based Composition B onto the porous layer, winding the porous medium into a roll.

Examples of a component employed in the Water-based Composition B are those which forms coagulants in the Water-based Composition A or increases viscosity of Water-based Composition A, when the component is added in the Water-based Composition A.

The example of the component is an organic or inorganic acid, an alkaline additive, a water-soluble salt of water-soluble multivalent metal ion, a surface active agent, an anti-discoloring agent, a cationic fixing agent, or a crosslinking agent of a binder.

Preferable example of the component is a water-soluble salt of a multivalent metal ion.

The other embodiments are described.

1. In a production method of a porous medium comprising a series of processes in which Water-based Composition A, comprising inorganic microparticles of an average primary particle diameter of less than or equal to 30 nm and a hydrophilic binder, is applied onto a non-water absorptive support, and after forming a porous layer by drying the coating which is formed by said Water-based Composition A, Water-based Composition B is subjected to coating onto said porous layer, a production method of a porous medium wherein said Water-based Composition A comprises the compound of a molecular weight of less than or equal to 200, represented by afore-mentioned General Formula (1).

General Formula (1)

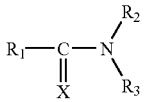

wherein $R_1$ represents a hydrogen atom, a substituted or unsubstituted alkyl group, an alkenyl group, an aryl group, an acyl group, a heteroaryl group, a heterocyclic group, $NR_4R_5$, or $OR_6$; $R_2$—$R_6$ are as defined for $R_1$; further, $R_1$ and $R_2$, and $R_1$ and $R_3$ may be joined together to form a ring; and X represents an oxygen atom or NH.

2. The production method of a porous medium, described in item 1, wherein the compound represented by said General Formula (1) is urea or its derivative.

3. The production method of a porous medium, described in item 1 or 2, wherein an amount of inorganic microparticles (F) in said porous layer is at least 10 g/m$^2$ and the weight ratio (F/B) of said inorganic microparticles (F) to a hydrophilic binder (B) in said porous layer is 2–20.

4. The production method of a porous medium, described in any one of items 1–3, wherein said Water-based Composition A is coated and dried, and thereafter, prior to winding it into a roll, said Water-based Composition B is subjected to coating.

5. The production method of a porous medium, described in any one of items 1–4, wherein said Water-based Composition B incorporates a multivalent metal compound.

DETAILED DESCRIPTION OF THE INVENTION

The present invention will now be detailed.

In a porous medium production method comprising a series of processes in which Water-based Composition A, comprising inorganic microparticles and hydrophilic binders, is applied onto a non-water absorptive support, and after forming a porous layer by drying a coating which is formed by the aforesaid Water-based Composition A, Water-based Composition B is subjected to coating onto that porous layer, the following coating problems may result. During coating of Water-based Composition A coating problems include so-called repellency problems and cracking problems, while coating problems which occur during coating of Water-based Composition B include, other than the repellency problems, a problem of an increase in polka dot glossiness (hereinafter also referred to as a polka dot problem) which is caused by non-uniform thickness of the liquid coating composition, and problems in which additives in the liquid coating composition are deposited on the surface of the coating (hereinafter also referred to as a deposition problem).

The inventors have found that the problems were markedly overcome by the addition of the compounds at a molecular weight of less than or equal to 200 represented by aforesaid General Formula (1), particularly preferably urea or its derivatives (hereinafter also referred to as ureas), whereby the present invention was achieved.

At present, details of the mechanism to minimize generation of the above coating problems is not clearly understood, but it is assumed to be as follows.

The first is that the porous layer itself, prepared by coating Water-based Composition A comprising the compounds represented by aforesaid General Formula (1), especially ureas, results in effects to reduce the aforesaid problems. Obviously, it is required to avoid coating defects of several millimeters which deteriorate the appearance of the porous medium. It is assumed that even defects of several 10 μm to several 100 μm, which are not recognized by the naked eye result in problems, especially repellency problems when Water-based Composition B is coated.

The second is that when Water-based Composition B penetrates into the porous layer, the penetration rate is a factor. When the penetration rate is low, non-uniform thickness of the coating layer becomes a factor in the formation of the polka dot problem. On the other hand, it is assumed that the compounds represented by aforesaid General Formula (1), especially ureas, function to enhance the penetration rate.

The third is that during penetration of Water-based Composition B into the porous layer, when it results in any interaction (especially coagulation) with the components of the porous layer, the compounds represented by the aforesaid General Formula (1), especially ureas, reduce the above interaction. Specifically, when multivalent metal compounds are incorporated into Water-based Composition B, it is assumed that the components in the porous layer interact with the multivalent metals to form coagulants, whereby deposition problems occasionally result.

First, the compounds represented by aforesaid General Formula (1) according to the present invention will be described.

In the Formula (1), $R_1$, $R_2$ and $R_3$ each represents a hydrogen atom, a substituted or unsubstituted alkyl group such as a methyl group, an ethyl group, an isopropyl group, a t-butyl group, a hexyl group, a dodecyl group, and a cycloalkyl group; a substituted or unsubstituted alkenyl group such as a propenyl group, a butenyl group, and a nonenyl group; a substituted or unsubstituted aryl group such as a phenyl group; a substituted or unsubstituted acyl group such as an acetyl group, a propionyl group, a butanoyl group, a hexanoyl group, a cyclohexanoyl group, a benzoyl group, and pyridinoyl group; a substituted or unsubstituted heteroaryl group such as a triazole group, an imidazole group, a pyridine group, a furan group, and a thiophene group; a substituted or unsubstituted heterocyclic group such as a pyridyl group, a thiazolyl group, an oxazolyl group, an imodazolyl group, a furyl group, a pyrrolyl group, a pyrazinyl group, a pyrimidinyl group, a pyridazinyl group, a selenazolyl group, a sulforanyl group, a piperidinyl group, a pyrazolyl group, and a tetrazolyl group; $NR_4R_5$, or $OR_6$. $R_4$, $R_5$ and $R_6$ each represents the same group as $R_1$ defined above. $R_1$ and $R_2$, and $R_1$ and $R_3$ may be joined together to form a ring. X represents an oxygen atom or NH.

X is preferably an oxygen atom.

$R_1$ and $R_4$ may be joined together to form a ring.

Examples of the substituents for $R_1$, $R_2$, $R_3$, $R_4$ and $R_5$ includes carbamoyl, cyano, and aldehyde group. Preferable example of $R_4$ and $R_5$ includes a hydrogen atom, an alkyl, amino, and cyano group.

When $R_1$ is $NR_4R_5$, $R_4$ is preferably a hydrogen atom or an alkyl group and $R_5$ is preferably an alkyl group. When $R_1$ is $OR_6$, $R_6$ is preferably a hydrogen atom or an alkyl.

It is preferable that the compounds represented by aforesaid General Formula (1) have no alcoholic hydroxyl group in order to exhibit the targeted effects of the invention.

The compounds represented by the Formula (1) are preferably to have a molecular weight of less than or equal to 200 and more preferably have the number of less than or equal to 15 atoms except for hydrogen atoms. Further, in view of facilitating the addition, they are preferably water-soluble.

Examples of the compounds are listed below.

1

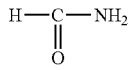

2

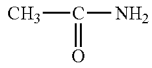

3

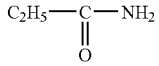

4

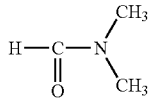

5

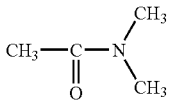

6

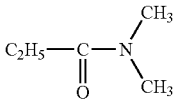

7

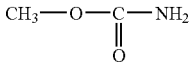

8

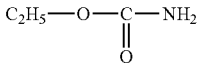

9

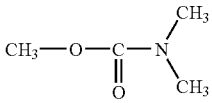

10

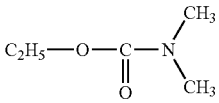

11

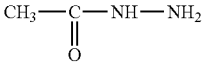

12

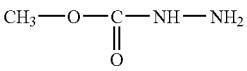

13

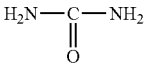

14

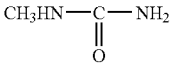

-continued
15
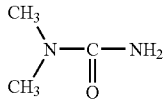
16
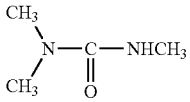
17
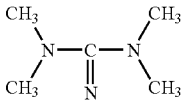
18
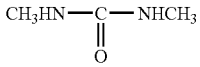
19
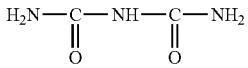
20
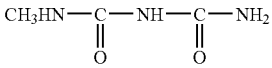
21
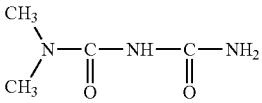
22
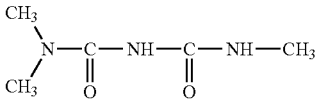
23
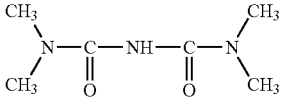
24
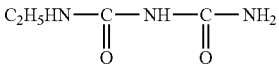
25
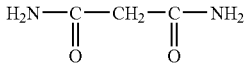
26
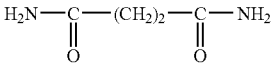
27
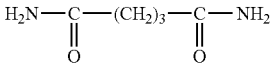
28
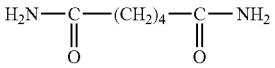
29
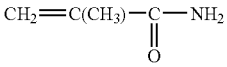
30
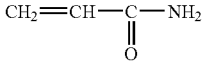
-continued
31
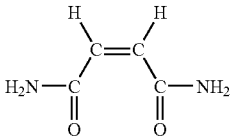
32
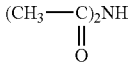
33
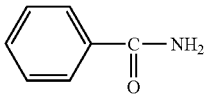
34
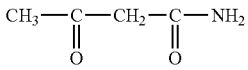
35
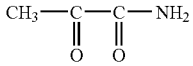
36
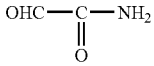
37
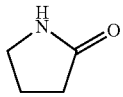
38
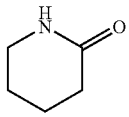
39
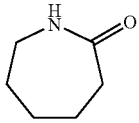
40
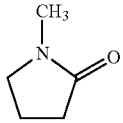
41
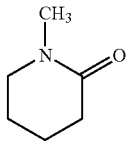
42
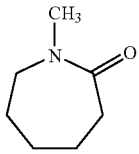
43
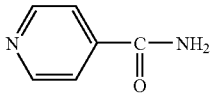
44
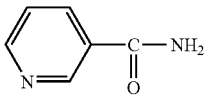

-continued

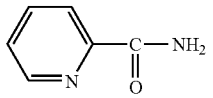

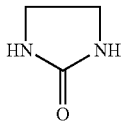

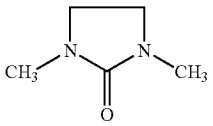

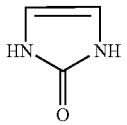

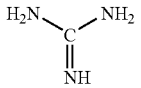

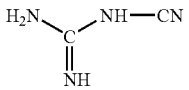

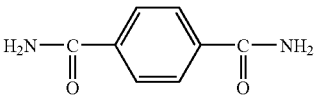

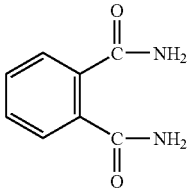

The preferable examples are

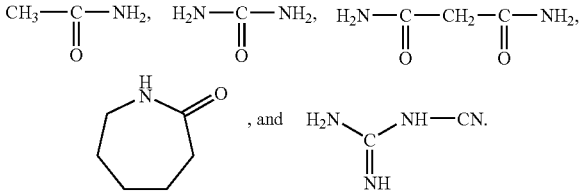

The compounds may be synthesized, based on the methods known in the art in this industry. Further, they may be commercially available.

Urea or its derivatives are preferred of the compounds represented by aforesaid General Formula (1) specifically. Basically, the urea derivatives have a structure such that any of the hydrogen atoms of the amino group of urea is modified with another functional group. The modifying group may be only one or plural ones, and a plurality of the modifying groups may be joined together to form a ring. Examples of urea and its derivatives preferably usable in the present invention include urea and alkyl ureas such as methylurea, ethylurea, N,N'-dimethylurea, ethyleneurea, or N,N'-dihydroxyethylurea. Of these, urea is particularly preferred.

Water-based Compositions A and B may comprise less than or equal to 30 percent by weight of water compatible organic solvents. Water compatible organic solvents, as described herein, refer to organic solvents including alcohols such as methanol, ethanol, isopropanol, or n-propanol; glycols such as ethylene glycol, diethylene glycol, or glycerin; esters such as ethyl acetate, or propyl aerate; ketones such as acetone or methyl ethyl ketone; which are soluble in water in an amount of at least 10 percent. In this case, it is preferable that the amount of organic solvents is less than or equal to that of water.

The Water-based Composition A comprises a compound of Formula 1. It is preferable that addition is carried out employing an aqueous solution containing only ureas. They may be added at any time, for example, employing so-called in-line addition just before coating.

Water-based Composition A will now be described.

The aforesaid Water-based Composition A, other than the compound of Formula 1, is basically a liquid coating composition to form a porous layer. In the production method of a minute pore bearing porous medium (hereinafter also referred to as a porous ink jet recording sheet), it is possible to use conventional liquid coating compositions, which comprise inorganic microparticles and hydrophilic binders as major components.

Listed as inorganic microparticles usable in the porous media according to the present invention may for example be white inorganic pigments such as precipitated calcium carbonate, calcium carbonate heavy, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, or magnesium hydroxide.

In the present invention, in view of producing high quality prints employing porous media, preferred as inorganic microparticles are silica or alumina. Further, preferred are alumina, pseudo-boehmite, colloidal silica, and minute silica particles synthesized employing a gas phase method. Of these, minute silica particles synthesized employing a gas phase method are particularly preferred. The above-mentioned silica particles synthesized employing gas phase method may be any whose surface is modified by aluminum. The content ratio of aluminum incorporated into gas phase method silica particles of which surface is modified with aluminum is preferably 0.05–5 percent by weight with respect to silica.

The average primary particle diameter of employed inorganic microparticles is less than or equal to 30 nm. Further, the average primary particle diameter is preferably 3–20 nm, and is more preferably 5–10 nm.

The average diameter of inorganic microparticles is determined as follows. The cross section and surface of a porous layer are observed employing an electron microscope and the diameter of 100 randomly selected particles is determined. The average diameter is then obtained as a simple average value (a number average value). Herein, the diameter of each particle is represented by the diameter of a circle which has the same area as the projected area of each particle.

The above-mentioned inorganic microparticles may be present in a porous layer in the form of primary particles, without any modification, secondary particles, or higher order coagulated particles. The above average primary particle diameter refers to the diameter of particles which are independently present in the porous layer when observed employing an electron microscope.

The content of the above inorganic microparticles in Water-based Composition A is preferably 5–40 percent by weight, and is particularly preferably 7–30 percent by weight. The above inorganic microparticles are required to exhibit sufficient ink absorbability and to form a porous layer which results in minimal layer cracking. The coating weight in the porous layer is preferably at least 10 g/m$^2$, is more preferably 10–55 g/m$^2$, and is particularly preferably 10–25 g/m$^2$.

Hydrophilic binders will now be described.

Hydrophilic binders incorporated into the porous layer are not particularly limited and include most hydrophilic binders. For example, employed may be gelatin, polyvinylpyrrolidone, polyethylene oxide, polyacrylamide, or polyvinyl alcohol. Of these, polyvinyl alcohol is most preferred.

Polyvinyl alcohol interacts with inorganic microparticles and exhibits particularly high retention power for inorganic microparticles. Further, polyvinyl alcohol is a polymer which exhibits relatively low humidity dependence and exhibits small shrinkage stress during drying. As a result, it exhibits desired crack resistance during coating and drying. Polyvinyl alcohols preferably employed in the present invention include common polyvinyl alcohol prepared by hydrolyzing polyvinyl acetate, and in addition, also include modified polyvinyl alcohol such as cation-modified polyvinyl alcohol at the terminal, as well as anion-modified polyvinyl alcohol having an anionic group.

Preferably employed are polyvinyl alcohols of an average degree of polymerization of at least 3,000, which are prepared by hydrolyzing polyvinyl acetate, are, and those of an average degree of polymerization of 1,000–5,000 are particularly preferred. Those of a saponification ratio of 70–100 percent are preferred, but those of a saponification ratio of 80–99.8 percent are most preferred.

Cation-modified polyvinyl alcohol refers to one having a primary, secondary, or tertiary amino group, or a quaternary amino group on the main or side chain of the above-mentioned polyvinyl alcohols. This is prepared by saponifying copolymers of ethylenic unsaturated monomers having a cationic group with vinyl acetate, as disclosed, for example, in JP-A No. 61-10483.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-methylvinylimidazole, N-(3-dimethylaminopropyl)methacrylamide, hydroxyethyltrimethylammonium chloride, and trimethyl-(3-methacrylamidopropyl) ammonium chloride.

The ratio of cation-modifying groups containing monomers of cation-modified polyvinyl alcohol to vinyl acetate is customarily 0.1–10 mol percent, and is preferably 0.2–5 mol percent.

Listed as anion-modified polyvinyl alcohols are, for example, polyvinyl alcohol having an anionic group described in JP-A No. 1-206088, copolymers of polyvinyl alcohol with vinyl compounds having a water solubilizing group described in JP-A Nos. 61-237681 and 63-307979, and modified polyvinyl alcohol having a water solubilizing group described in JP-A No. 7-285265.

Further, listed as nonion-modified polyvinyl alcohols are, for example, polyvinyl alcohol derivatives in which a polyalkylene oxide group is added to a part of vinyl alcohol, described in JP-A No. 7-9758, and block copolymers of hydrophobic group containing vinyl compounds along with vinyl alcohol, described in JP-A No. 8-25795.

Polyvinyl alcohols may be employed in combinations of at least two types, differing in the degree of polymerization and modification types. Specifically, when polyvinyl alcohol, at a degree of polymerization of at least 2,000, is employed, it is preferable that the above-mentioned polyvinyl alcohol is added in an amount of 0.05–10 percent by weight and preferably 0.1–5 percent by weight with respect to inorganic microparticles, and thereafter, polyvinyl alcohol of a degree of polymerization of at least 2,000 is added to minimize any significant increase in viscosity.

In the porous medium according to the present invention, the ratio (F/B) of inorganic microparticles (F) to hydrophilic binders (B) incorporated into the porous layer is preferably 2–20 in terms of weight. When the weight ratio is a factor of at least 2, a porous layer having a desired pore ratio is prepared with the desired pore volume whereby pores are not closed by swelling of holding hydrophilic binders during ink jet printing, and a high ink absorption rate is maintained. On the other hand, when the above-mentioned ratio is at most 20, cracking tends to be minimized in the case in which a relatively thick porous layer is coated. The ratio F/B of inorganic microparticles to hydrophilic binders is more preferably 2.5–12, and is most preferably 3–10.

For the purpose of minimizing image bleeding due to storage after recording, cationic polymers are preferably incorporated into the porous media according to the present invention.

Examples of cationic polymers include polyethyleneimine, polyallylamine, polyvinylamine, dicyandiamidopolyalkyelenepolyamine condensation products, polyalkylenepolyaminediamidoammonium salt condensation products, dicyandiamidoformalin condensation products, epichlorohydrin-dialkylamine addition polymers, diallyldimethylammonium chloride polymers, diallyldimethylammonium chloride-$SO_2$ copolymers, polyvinyl imidazole, vinylpyrrolidone-vinyl imidazole copolymers, polyvinylpyridine, polyamidine, chitosan, cationic starch, vinylbenzyltrimethylammonium chloride polymers, (2-methacroyloxyethyl) trimethylammonium chloride copolymers, and dimethylaminoethyl methacrylate polymers.

Further, examples include cationic polymers described in Kagaku Kogyo Jiho (Chemical Industry News) dated Aug. 15 and 25, 1998, and polymer dye fixing agents described in "Kobunshi Yakuzai Nyumon (Introduction to Polymer Medicines)", published by Sanyo Chemical Industry Co., Ltd.

It is preferable to use hardeners which harden the hydrophilic binders forming the porous layer in the porous media according to the present invention.

Hardeners undergo hardening reaction with hydrophilic binders, and generally include compounds having a group capable of reacting with hydrophilic binders or compounds which accelerate the reaction between different groups in hydrophilic binders, and are appropriately employed depending on the types of hydrophilic binders. Listed as specific examples of hardeners are boric acids and salts thereof epoxy based hardeners (glycidyl ethyl ether, ethylene glycol diglycidyl ether, 1,4-butanedioldiglycidyl ether, 1,6-diglycidylcyclohexane, N,N-diglycidyl-4-glycidyloxyaniline, sorbitol polyglycidyl ether, and glycerol polyglycidyl ether), aldehyde based hardeners (formaldehyde and glyoxal), active halogen based hardeners (2,4-dichloro-hydroxy-1,3,5-s-triazine), active vinyl based compounds (1,3,5-trisacryloyl-hexahydro-s-triazine and bisvinylsulfonyl methyl ether), and aluminum alum. Boric acids and salts thereof are preferred among them.

Boric acids or salts thereof, as described herein, refer to oxygen acids having a boron atom as a center atom, and salts thereof. Specifically listed are orthoboric acid, diboric acid, metaboric acid, tetraboric acid, pentaboric acid, and octaboric acid, and salts thereof.

Boric acids having a boron atom as a hardener and salts thereof may be employed in the form of an individual aqueous solution or a mixture of at least two types. An aqueous solution containing boric acid and borax is particularly preferred.

Due to relatively low solubility of boric acid, as well as borax, in water, it is only possible to add an aqueous boric acid solution or an aqueous borax solution at a relatively low concentration. However, when both are simultaneously employed, it is possible to prepare an aqueous solution at a relatively high concentration, whereby it is possible to concentrate the liquid coating compositions. Further, a resulting advantage is that it is possible to relatively easily control the pH of the aqueous solution to be added. The total amount of the above-mentioned hardeners used is preferably 1–600 mg per g of the binders.

The support employed in the present invention is preferably not water absorptive.

Non-water absorptive supports include transparent support and opaque supports. Listed as transparent supports are films comprised of polyester based resins, diacetate based resins, triacetate based resins, acryl based resins, polycarbonate based resins, polyvinyl chloride based resins, polyimide based resins, cellophane, and celluloid. Of these, preferred are those which exhibit resistance to radiation heat, when used for OHP, for which polyethylene terephthalate is particularly preferred. The thickness of such transparent supports is preferably 50–200 μm.

Further, preferred as opaque supports are, for example, resin coated paper (so-called RC paper) which comprises a base paper having on at least one side a polyolefin resin covering layer comprising white pigments, and white PET which is prepared by adding white pigments such as barium sulfate to polyethylene terephthalate.

For the purpose of enhancing the adhesion strength between any of the above-mentioned various supports and the porous layer, it is preferable that supports are subjected to corona discharge treatment prior to coating the porous layer. Further, the porous media according to the present invention need not always be colorless and may be tinted recording sheets.

It is particularly preferred to use paper supports which are laminated on both sides with polyethylene because recorded image quality approaches that of conventional photography and high quality images are prepared at lower cost in the porous media according to the present invention.

Paper supports laminated with polyethylene will now be described.

Base paper employed for the paper supports is made employing wood pulp as the major raw material, and if desired, employing synthetic pulp such as polypropylene, or synthetic fiber such as nylon or polyester in addition to wood pulp. As wood pulp, any of LBKP, LBSP, NBKP, NBSP, LDP, NDP, LUKP, and NUKP may be employed. And, it is preferable that LBKP, NBSP, LBSP, NDP, and LDP, comprised of a large amount of short fibers, are employed in a larger amount. The ratio of LBSP and/or LDP is preferably 10–70 percent by weight.

Chemical pulp such as sulfate salt pulp and sulfite pulp, containing minimal impurities, is preferably employed, and pulp which is subjected to a bleaching treatment to increase whiteness is also beneficial.

Suitably incorporated into base paper may be sizing agents such as higher fatty acids or alkylketene dimers, white pigments such as calcium carbonate, talc, or titanium oxide, paper strength enhancing agents such as starch, polyacrylamides, or polyvinyl alcohol, optical brightening agents, humectants such as polyethylene glycol, dispersing agents, and softening agents such as quaternary ammonium.

The freeness of pulp employed for paper making is preferably 200–500 ml under the CSF specification. Further, regarding fiber length after beating, the sum of the 24 mesh residue and the 42 mesh residue, specified in JIS P 8207, is preferably 30–70 percent. Incidentally, 4-mesh residue is preferably at most 20 percent. The basic weight of base paper is preferably 30–250 g, and is particularly preferably 50–200 g, while the thickness of base paper is preferably 40–250 μm. Base paper of high smoothness may result by employing calendering during or after paper making. The density of paper is customarily 0.7–1.2 g/cm$^2$ (JIS P 8118). Further, the stiffness of paper is preferably 20–200 g under conditions specified in JIS P 8143. Surface sizing agents may be applied onto the surface of base paper. Employed as surface sizing agents may be the same ones as those which can be incorporated into the above-mentioned base paper. The pH of base paper, when determined by the hot water extraction method specified in JIS P 8113, is preferably 5–9.

Polyethylene, employed to coat both sides of base paper, is mainly comprised of low density polyethylene (LDPE) and/or high density polyethylene (HDPE). However, it is possible to partly use LLDPE and polypropylene.

It is preferable that as widely performed for photographic paper, rutile or anatase type titanium oxide is added to the polyethylene layer on the porous layer side so that opacity as well as whiteness is improved. The proportion of titanium oxide is customarily 3–20 percent by weight, and is preferwbly 4–13 percent by weight.

In the present invention, polyethylene coated paper may be employed as a form of glossy paper. Further, while coating polyethylene onto the surface of base paper via melt-extrusion, a so-called embossing process may be carried out and matte or silk surface paper, as prepared for common photographic paper, may be employed in the present invention. In the above-mentioned polyethylene coated paper, it is particularly preferable that the moisture content of the paper is maintained at 3–10 percent by weight.

It is possible to add various additives to porous media according to the present invention in addition to the above-mentioned components. For example, incorporated may be various prior art additives including polystyrene, polyacrylic acid esters, polymethacrylic acid esters, polyacrylamides, polyethylene, polypropylene, polyvinyl chloride, polyvinylidene chloride, or copolymers thereof, minute organic latex particles of urea resins or melamine resin, cationic surface active agents, UV absorbers described in JP-A Nos. 57-74193, 57-87988, and 62-261476, anti-discoloring agents described in JP-A Nos. 57-74192, 57-87989, 60-72785, 61-146591, 1-95091, and 3-13376, optical brightening agents described in JP-A Nos. 59-42993, 59-52689, 62-280069, 61-242871, and 4-219266, pH control agents such as sulfuric acid, phosphoric acid, citric acid, sodium hydroxide, potassium hydroxide, and potassium carbonate, defoamers, thickeners, antistatic agents, and matting agents.

The forming method of the porous layer in the production method of the porous media of the present invention will now be described.

It is possible to produce the porous media in such a manner that constituting layers including the porous layer are each independently or simultaneously applied onto a non-water absorptive support, employing an appropriate coating systems. Preferably employed as coating systems are, for example, a roll coating method, a rod bar coating method, an air knife coating method, a spray coating method, a curtain coating method, a slide bead coating method, described in U.S. Pat. Nos. 2,761,419 and 2,761,791 and an extrusion coating method.

During simultaneous multilayer coating for forming the porous layer, when the above slide bead coating system is employed, the viscosity of each liquid coating composition is preferably of 5–100 mPa·s, and is more preferably of 10–50 mPa·s. Further, when a curtain coating system is employed, the above-mentioned viscosity is preferably of 5–1,200 mPa·s, and is more preferably of 25–500 mPa·s.

Further, the viscosity of a liquid coating composition for forming the porous layer at 15° C. is preferably at least 100 mPa·s, is more preferably 100–30,000 mPa·s, is still more preferably 3,000–30,000, and is most preferably 10,000–30,000 mPa·s.

A coating and a drying methods follow. A liquid coating composition is heated to at least 30° C. and applied onto a support. Thereafter, it is preferable that the resulting coating is temporarily cooled to 1–15° C. and subsequently dried at 10° C. or higher. It is more preferable that drying is carried out at the conditions of a wet bulb temperature of 5–50° C. and a layer surface temperature in the range of 10–50° C. Further, in view of uniform coating, it is preferable to use a horizontal setting system as a cooling system immediately after coating.

In the production method of the porous media of the present invention, one of the characteristics is that the aforesaid method comprises a series of processes, in which after forming the porous layer by drying a coating formed by Water-based Composition A, Water-based Composition B is subjected to coating onto the resulting porous layer. It is more preferable that after coating Water-based Composition A and subsequently drying the resulting coating, Water-based Composition B is subjected to coating prior to winding the dried coating into a roll.

Water-based Composition B according to the present invention will now be described. The above-mentioned Water-based Composition B is a liquid coating composition which penetrates into the porous layer which has been formed employing the above-mentioned Water-based Composition A and provides various functions to the porous layer to prepare a porous medium exhibiting higher performance. In order to allow optimal penetration into the porous layer, it is preferable that coating is carried out at viscosity of about 1-about 30 mPa·s.

The constitution of Water-based Composition B variously varies depending on desired functions to be provided. For example, in order to enhance lightfastness, gas resistance, water resistance, moisture resistance, and the rate of ink absorption, various types of conventional additives may incorporated.

Further, it is possible to apply the above-mentioned method to compounds which can be incorporated into Water-based Composition A but tend to enhance cracking during drying, compounds which form coagulants or markedly decrease or increase the viscosity of Water-based Composition A for the porous layer when added to Water-based Composition A, and compounds which hardly exhibit effective results due to adverse reaction with water or other additives in a coated layer when added to Water-based Composition A for the porous layer. Examples include organic or inorganic acids which vary pH by the addition of the aforesaid additives, or various alkaline additives, water-soluble salts of multivalent metal ions, various anionic, cationic, amphoteric, or nonionic surface active agents, anti-discoloring agents, cationic fixing agent, and crosslinking agents of hydrophilic binders. Of these, in view of enhancing moisture resistance, multivalent metal compounds are markedly effective, while when added to Water-based Composition A, coagulants tend to form. Consequently, in the present invention, it is preferable that they are incorporated into Water-based Composition B.

Multivalent metal compounds which are preferably employed in Water-based Composition B according to the present invention are not particularly limited as long as they posses divalent or higher valent metal ions. Listed as preferable multivalent metal ions are aluminum ions, zirconium ions, and titanium ions.

It is possible to incorporate these multivalent metal ions into a porous layer in the form of water-insoluble salts. Listed as specific examples of aluminum ion containing salts may be aluminum fluoride, hexafluoroaluminic acid (e.g. potassium salts), aluminum chloride, basic aluminum chloride (e.g. polyaluminum chloride), tetrachloroaluminates (e.g. potassium salts), aluminum iodide, aluminates (e.g. sodium salts, potassium salts, and calcium salts), aluminum chlorate, aluminum perchlorate, aluminum thiocyanate, aluminum sulfate, basic aluminum sulfate, aluminum potassium sulfate (alum), aluminum ammonium sulfate (ammonium alum), aluminum sodium sulfate, aluminum phosphate, aluminum nitrate, aluminum hydrogenphosphate, aluminum carbonate, polyaluminum sulfate silicate, aluminum formate, aluminum acetate, aluminum lactate, aluminum oxalate, aluminum isopropylate, aluminum butyrate, ethylacetate aluminum diisopropylate, aluminum tris(acetylacetonate), aluminum tris(ethylacetate), and aluminum monoacetylacetonate bis(ethylacetoacetonate).

Of these, preferred are aluminum chloride, basic aluminum chloride, aluminum sulfate, basic aluminum sulfate, and basic aluminum sulfate silicate. Of these, basic aluminum chloride and basic aluminum sulfate are most preferred.

Further, listed as specific examples of zirconium ion containing salts are zirconium difluoride, zirconium trifluoride, zirconium tetrafluoride, hexafluorozirconates (e.g. potassium salts), heptafluorozirconates (e.g. sodium salt, potassium salts, and ammonium salts), octafluorozirconates (e.g. lithium salts), zirconium fluoride oxide, zirconium dichloride, zirconium trichloride, zirconium tetrachloride, hexachlorozirconates (e.g. sodium salts and potassium salts), acidic zirconium chloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfite trihydrate, potassium zirconyl sulfate, zirconium selenate, zirconium nitrate, zirconyl nitrate, zirconium phosphate, zirconyl carbonate, zirconyl ammonium carbonate, zirconium acetate, zirconyl acetate, zirconyl ammonium acetate, zirconyl lactate, zirconyl citrate, zirconyl stearate, zirconyl phosphate, zirconium oxalate, zirconium isopropylate, zirconium butyrate, zirconium acetylacetate, acetylacetone zirconium butyrate, stearic acid zirconium butyrate, zirconium acetate, bis(acetylacetonato)dichlorozirconium, and tris(acetylacetonato)chlorozirconium.

Of these compounds, preferred are zirconyl carbonate, zirconyl ammonium carbonate, zirconyl acetate, zirconyl nitrate, zirconyl chloride, zirconyl lactate, and zirconyl citrate. Of these, particularly preferred are zirconyl ammonium carbonate, zirconyl chloride, and zirconyl acetate. These multivalent metal ions may be employed individually or in combinations of at least two types.

The employed amount of these multivalent metal ions is commonly of about 0.05-about 20 millimol per $m^2$ of the recording sheet and is preferably of 0.1–10 millimol.

Water-based Composition B are coated by a conventional coating methods in the same manner as for Water-based Composition A. Specifically, it is preferable that coating of Water-based Composition B is carried out immediately after coating and drying of Water-based Composition A. Namely, in the case of coating employing a non-water absorptive support of an extended length, a winding process is invariably provided after coating and drying. However, in view of production cost, it is preferable that prior to winding, Water-based Composition B according to the present invention is coated and dried.

Further, coating of Water-based Composition B may be initiated even though Water-based Composition A is not completely dried. The above-mentioned coating is carried out when it is difficult to mix a component of coating composition B with water-based coating composition A to form a single coating composition. Consequently, coating of Water-based Composition B should not be initiated before Water-based Composition A forms pores. Coating of liquid coating composition B prior to winding refers to coating before the preceding coating results in a stable structure. Therefore, problems tend to increase. However, the presence of the compound of Formula 1 in the porous layer minimizes the above problems.

Water-based Composition B may be coated employing any suitable coating method. Employed as specific coating systems may be the methods described in the above-mentioned porous layer coating. Particularly preferred systems are a gravure coating system or a system described in JP-A No. 2002-331745, in which a solution is sprayed in the form of droplets. A particularly preferred system is that a solution is fed employing a slot nozzle spray apparatus which comprises a plurality of minute nozzles across the coating width, which spout gases.

It is preferable that Water-based Composition B is coated at from room temperature to 60° C.

It is preferable that Water-based Composition B is filtered prior to coating. Specifically, when the above-mentioned slot nozzle spray apparatus provided with gas nozzles is employed as a coating system, minute foreign matter such as dust tends to clog nozzles, resulting coating streaks. It is generally preferable to use filters capable of capturing particles at about 5 to about 20 μm.

It is preferable that the resulting porous medium is wound into a roll after drying.

At that time, in the present invention, it is preferable that winding is carried out in such a state in which at least 50 percent of the solvents fed for over-coating are dried.

By winding in the state in which at least 50 percent of the fed solvents are dried, it is possible to retard increasing curl after cutting and also possible to retard generation of unevenness during storage of the resulting roll, whereby it is possible to minimize streaking problems. It is preferable that drying is carried out so that the weight of the fed solvents is reduced to at most ⅓, and drying is carried out to achieve an equilibrium state in the ambience.

Further, when porous media are stored, it is preferable that the porous media stored in the form of a roll, or stored after cutting into sheets, after coating and drying of Water-based Composition B. When stored at 30° C. or more for a definite period, such as one day to one month, the rate of ink absorption is improved to decrease non-uniformity in mottled appearance. Preferred storage conditions are 30 to 50° C. and 1 to 30 days.

EXAMPLES

The present invention will now be described with reference to examples. A term of "Percents" described in the examples is % by weight unless otherwise specified.

<<Preparation of Liquid Coating Compositions>>

(Preparation of Silica Dispersions D-1–D-3)

(Preparation of Silica Dispersion D-1)

While stirring at 3,000 rpm at room temperature, 400 L of silica dispersion S-1 (at a pH of 2.6 and containing 0.5% methanol) containing 25% gas phase method silica (bearing the trade name of Aerosil 300, manufactured by Nippon Aerosil Co. Ltd.) of an average primary particle diameter of about 7 nm, which had been uniformly dispersed, was added to 110 L of aqueous solution C-1 (at a pH of 2.5 and containing 2 g of defoamer SN-381, manufactured by San Nopco Ltd.) containing 12% Cationic Polymer P-1, 10% n-propanol, and 2% ethanol. Subsequently, while stirring, 54 L of aqueous mixture solution H-1 containing boric acid and borax at a weight ratio of 1:1 (each at a concentration of 3%) was gradually added.

Subsequently, the resulting mixture was dispersed under a pressure of 3 kN/$cm^2$, employing a high pressure homogenizer, manufactured by Sanwa Industry Co., Ltd. The total volume of the resulting dispersion was adjusted to 630 L by the addition of pure water, whereby nearly transparent Silica Dispersion D-1 was prepared.

(Preparation of Silica Dispersion D-2)

While stirring at 3,000 rpm at room temperature, 400 L of the above-mentioned silica dispersion S-1 was added to 120 L of aqueous solution C-2 (at a pH of 2.5) containing 12% Cationic Polymer P-2, 10% n-propanol, and 2% ethanol. Subsequently, while stirring, 52 L of the above aqueous mixture solution H-1 was gradually added. The resulting mixture was dispersed under a pressure of 3 kN/$cm^2$, employing a high pressure homogenizer, manufactured by Sanwa Industry Co., Ltd. The total volume of the resulting dispersion was adjusted to 630 L by the addition of pure water, whereby nearly transparent Silica Dispersion D-2 was prepared.

Cationic Polymer P-1

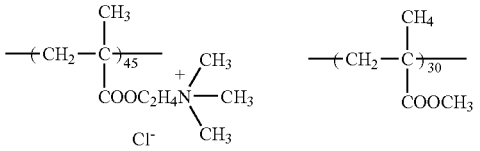

-continued

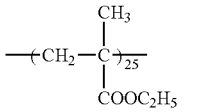

Cationic Polymer P-2

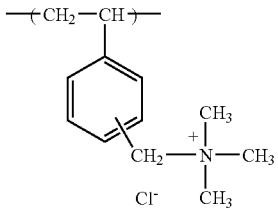

(Preparation of Silica Dispersion D-3)

While stirring at 3,000 at room temperature, 400 L of the above-mentioned silica dispersion S-1 was added to 120 L of aqueous solution C-3 (at a pH of 2.5) containing 9% polydiallyldimethylammonium chloride (PAS-H-10 L, manufactured by Nitto Boseki Co., Ltd.), 10% n-propanol, and 2% ethanol. Subsequently, the resulting mixture was dispersed under a pressure of 3 kN/cm$^2$, employing a high pressure homogenizer, manufactured by Sanwa Industry Co., Ltd. The total volume of the resulting dispersion was adjusted to 630 L by the addition of pure water, whereby nearly transparent Silica Dispersion D-3 was prepared.

Subsequently, Silica Dispersions D-1–D-3 were filtered employing a Type TCP-30 filter at a filtration accuracy of 30 μm, manufactured by Advantech Toyo Co.

(Preparation of Water-Based Compositions A-1–A-3)

Water-based Porous Layer Liquid Coating Composition A-1 was prepared by successively adding each of the additives described below to each of the dispersions prepared as above. Each of the liquid compositions was maintained at 40° C. Each of the added amounts is expressed per L.

| | |
|---|---|
| Silica Dispersion D-1 | 630 ml |
| 10% aqueous polyvinyl alcohol (PVA203, manufactured by Kuraray Co., Ltd.) solution | 5 ml |
| 6.5% aqueous polyvinyl alcohol (at an average degree of polymerization of 3,800 and a saponification ratio of 88%) | 290 ml |
| Urea (aqueous 5% solution) | 30 ml |
| Surface Active Agent 1 (aqueous 4% solution, containing 30% isopropanol) | 5 ml |
| Pure water to make | 1000 ml |

Water-based Composition A-2 was prepared in the same manner as above, except that Silica Dispersion D-1 was replaced with Silica Dispersion D-2, while Water-based Composition A-3 was prepared as above, except that Silica Dispersion D-1 was replaced with Silica Dispersion D-3.

(Preparation of Water-Based Compositions A-4–A-8)

Water-based Compositions A-4–A-8 were prepared in the same manner as the aforesaid Water-based Composition A-2, except that urea (aqueous 5% solution) was replaced with each of the urea derivatives in an equal amount, as described in Table 1.

(Preparation of Water-Based Compositions A-9–A-11)

Each of Water-based Compositions A-9, A-10, and A-11 was prepared in the same manner as each of the aforesaid Water-based Compositions A-1, A-2, and A-3, except that urea was omitted.

Each of the Water-based Compositions prepared as above was filtered employing a TCPD-30 filter at a filtration accuracy of 20 μm, manufactured by Advantech Toyo Co. and subsequently also employing a TCPD-10 filter.

(Water-Based Composition B)

<Water-Based Composition B-1>

Water-based Composition B-1 was prepared in such a manner that Zircosol ZA (an aqueous zirconyl acetate solution, manufactured by Dai-ichi Kigenso Kagaku Kogyo Co.) was diluted with water so that the effective component (in terms of zirconium oxide) reached 0.5%.

<Water-Based Composition B-2>

Water-based Composition B-2 was prepared in such a manner that polyaluminum hydroxide was diluted with water so that the effective component (in terms of aluminum oxide) reached 0.5%.

<Water-Based Composition B-3>

Water-based Composition B-3 was prepared in such a manner that $HOC_2H_4SC_2H_4SC_2H_4OH$ was diluted with water so that the effective component reached 0.5%.

<Water-Based Composition B-4>

Water-based Composition B-4 was prepared in such a manner that boric acid was diluted with water so that the effective component reached 1.0%.

<Water-Based Composition B-5>

Water-based Composition B-5 was prepared in such a manner that Compound HAS-1 was diluted with water so that the effective component reached 5.0%.

Compound HAS-1

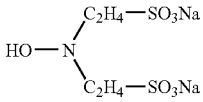

<Water-Based Composition B-6>

Water-based Composition B-6 was prepared in such a manner that polyallylamine (PAA-HCl-3 L), manufactured by Nitto Boseki Co., Ltd.) was diluted with water so that the effective component reached 1.0%.

<<Preparation of Porous Media>>

(Preparation of Porous Medium 1)

Water-based Composition A-1, prepared as above, was applied at a liquid temperature of 40° C. onto a paper support (RC paper) which was coated on both sides with polyethylene to result in a wet layer thickness of 170 μm, employing a slide hopper type coater.

Employed as the above RC paper was the following paper support at a width of about 1.5 m and a length of as about 4,000 m, which was wound into a roll.

The used RC paper was prepared as follows. Polyethylene containing 6% anatase type titanium oxide was melt-extruded at a thickness of 35 μm onto the surface of a photographic base paper of a moisture content of 8% and a basic weight of 170 g/m$^2$, and 40 μm thick polyethylene was melt-extruded onto the reverse surface. The obverse surface was subjected to corona discharge, and thereafter, by employing polyvinyl alcohol (PVA235, manufactured by Kuraray Co., Ltd.), a sublayer was applied onto the resulting surface to result in 0.05 g per $m^2$ of the RC paper. The reverse surface was also subjected to corona discharge and a back layer was applied onto the resulting surface to result in about 0.4 g of a styrene-acrylic acid ester based latex binder at a Tg of about 80° C., 0.1 g of an antistatic agent (a cationic polymer), and 0.1 g of a matting agent per $m^2$ of the RC paper.

After coating Water-based Composition A-1, being a porous layer liquid coating composition, the coating was passed through a 5° C. cooling zone and the coating surface was cooled to 13° C. Thereafter, temperatures of a plurality of drying zones were appropriately set and drying was carried out. At that time, the fact that pores were formed in the coating was separately confirmed through observation employing an electron microscope. Immediately after the drying, Water-based Composition B-1 prepared as described above was subjected to spray coating employing a slot nozzle spray under conditions of 30 kPa air pressure and a wet coated weight of 20 g/$m^2$. After drying the coating in provided drying zones, the resulting coating was wound into a roll, whereby Porous Medium 1 was prepared.

(Preparation of Porous Media 2–24)

Porous Media 2–24 were prepared in the same manner as above Porous Medium 1, except that types of Water-based Composition A used for forming a porous layer, types of Water-based Composition B which were subjected to coating onto the porous layer, coating systems, and coating duration were changed and combined as described in Table 1. Viscosity was measured by Viscometer Type B manufactured by Toki Sangyo Co., Ltd. Viscosity of the Coating Composition A-2 of other than Porous Medium No. 3 was adjusted to 42 95 mPa·s. Viscosity of Coating Composition A-2 of Porous Medium No. 3 was modified to 95 mPa·s by changing amount of water for convenience of curtain coating.

"After temporarily winding" described in the coating period of Water-based Composition A in each condition related to preparation of above-mentioned Porous Media 2–24 refers to a system in which after coating the porous layer employing Water-based Composition A and subsequently drying the resultant coating, the dried coating is wound onto a core member into a roll and subsequently, when Water-based Composition B is coated, coating is carried out by unwinding the porous layer-coated sample wound into a roll. Further, employed as a slide hopper, a slot nozzle spray, a curtain coater, a bar coater, or a gravure coater were apparatuses known in the art in this industry.

TABLE 1

| | Water-based Liquid Coating Composition A | | | | Water-based Liquid Coating Composition B | | | | |
|---|---|---|---|---|---|---|---|---|---|
| Porous Medium No. | Coating Composition Mo. | Urea Compounds | Viscosity (mPa · s) | Coating System | Coating Composition No. | Viscosity (mPa · s) | Coating System | Coating Time | Remarks |
| 1 | A-1 | urea | 54 | slide hopper | B-1 | 1.5 | slot nozzle spray | before winding | Inv. |
| 2 | A-2 | urea | 42 | slide hopper | B-1 | 1.5 | slot nozzle spray | before winding | Inv. |
| 3 | A-2(*) | urea | 95(*) | curtain coater | B-1 | 1.5 | slot nozzle spray | before winding | Inv. |
| 4 | A-2 | urea | 42 | slide hopper | B-2 | 1.5 | slot nozzle spray | before winding | Inv. |
| 5 | A-2 | urea | 42 | slide hopper | B-3 | 2.8 | slot nozzle spray | before winding | Inv. |
| 6 | A-2 | urea | 42 | slide hopper | B-4 | 1.5 | slot nozzle spray | before winding | Inv. |
| 7 | A-2 | urea | 42 | slide hopper | B-5 | 3.1 | slot nozzle spray | before winding | Inv. |
| 8 | A-2 | urea | 42 | slide hopper | B-6 | 1.7 | slot nozzle spray | before winding | Inv. |
| 9 | A-3 | urea | 35 | slide hopper | B-1 | 1.5 | slot nozzle spray | before winding | Inv. |
| 10 | A-3 | urea | 35 | slide hopper | B-2 | 1.5 | slot nozzle spray | before winding | Inv. |
| 11 | A-3 | urea | 35 | slide hopper | B-2 | 1.5 | slide hopper | after temporarily winding | Inv. |
| 12 | A-3 | urea | 35 | slide hopper | B-2 | 1.5 | bar coater | after temporarily winding | Inv. |
| 13 | A-3 | urea | 35 | slide hopper | B-2 | 1.5 | gravure coater | after temporarily | Inv. |

TABLE 1-continued

| Porous Medium No. | Water-based Liquid Coating Composition A: Coating Composition Mo. | Urea Compounds | Viscosity (mPa · s) | Coating System | Water-based Liquid Coating Composition B: Coating Composition No. | Viscosity (mPa · s) | Coating System | Coating Time | Remarks |
|---|---|---|---|---|---|---|---|---|---|
| 14 | A-4 | Exemplified Compound 2 | 41 | slide hopper | B-1 | 1.5 | slot nozzle spray | winding before winding | Inv. |
| 15 | A-5 | Exemplified Compound 25 | 42 | slide hopper | B-1 | 1.5 | slot nozzle spray | before winding | Inv. |
| 16 | A-6 | Exemplified Compound 28 | 41 | slide hopper | B-1 | 1.5 | slot nozzle spray | before winding | Inv. |
| 17 | A-7 | Exemplified Compound 39 | 43 | slide hopper | B-1 | 1.5 | slot nozzle spray | before winding | Inv. |
| 18 | A-8 | Exemplified Compound 50 | 41 | slide hopper | B-1 | 1.5 | slot nozzle spray | before winding | Inv. |
| 19 | A-9 | — | 53 | slide hopper | B-1 | 1.5 | slot nozzle spray | before winding | Comp. |
| 20 | A-10 | — | 44 | slide hopper | B-1 | 1.5 | slot nozzle spray | before winding | Comp. |
| 21 | A-11 | — | 33 | slide hopper | B-1 | 1.5 | slot nozzle spray | before winding | Comp. |
| 22 | A-11 | — | 33 | slide hopper | B-2 | 1.5 | bar coater | after temporarily winding | Comp. |
| 23 | A-11 | — | 33 | slide hopper | B-3 | 2.8 | slot nozzle spray | before winding | Comp. |
| 24 | A-11 | — | 33 | slide hopper | B-3 | 2.8 | slot nozzle spray | after temporarily | Comp. |

(*)Viscosity was modified to 95 mPa · s for convenience of curtain coating.
Inv.: Present Invention
Comp.: Comparative Example <<Evaluation of Coating Problems of Porous Media>>

Various coating problems on the surface of porous layer coating prepared as above were evaluated using the methods below.

(Evaluation of Repellency Problem Resistance)

The surface of the coated porous layer of each of the porous media was visually observed, and the number of repellency problems formed per 1,000 $m^2$ was recorded. Subsequently, the repellency problem resistance was evaluated using the criteria below.

A: the number of repellency problems was 0–5
B: the number of repellency problems was 6–30
C: the number of repellency problems was 31–100
D: the number of repellency problems was at least 101

(Evaluation of Polka Dot Problem Resistance)

The porous layer coated side of each of the porous media was visually observed and the number of polka dot problems (problems in which a coated liquid coating composition results in non-uniform thickness, whereby glossiness increases to form a polka dot pattern) was recorded. Subsequently, the polka dot problem resistance was evaluated employing the criteria below.

A: the number of polka dots was 0–5
B: the number of polka dots was 6–30
C: the number of polka dots was 31–100
D: the number of polka dots was at least 101

(Evaluation of Deposit Problem Resistance)

The porous layer coated side of each of the porous media was visually observed and the number of deposit problems (problems in which additives in a liquid coating composition deposit onto the surface of the coating) per 1,000 $m^2$ was recorded. Subsequently, the deposit problem resistance was evaluated using the criteria below.

A: the number of deposit problems was 0–5
B: the number of deposit problems was 6–30
C: the number of deposit problems was 31–100
D: the number of deposit problems was at least 101

Table 2 shows the obtained results.

TABLE 2

| Porous Medium No. | Problem Evaluation: Repellency Problem Resistance | Polka Dot Problem Resistance | Deposit Problem Resistance | Remarks |
|---|---|---|---|---|
| 1 | A | A | A | Inv. |
| 2 | A | A | A | Inv. |
| 3 | A | A | A | Inv. |
| 4 | A | A | A | Inv. |
| 5 | A | A | A | Inv. |

TABLE 2-continued

| Porous Medium No. | Problem Evaluation: Repellency Problem Resistance | Polka Dot Problem Resistance | Deposit Problem Resistance | Remarks |
|---|---|---|---|---|
| 6 | A | A | A | Inv. |
| 7 | A | A | A | Inv. |
| 8 | A | A | A | Inv. |
| 9 | A | A | A | Inv. |
| 10 | A | A | A | Inv. |
| 11 | A | B | A | Inv. |
| 12 | A | B | A | Inv. |
| 13 | B | A | A | Inv. |
| 14 | A | B | A | Inv. |
| 15 | B | A | A | Inv. |
| 16 | B | A | A | Inv. |
| 17 | A | B | A | Inv. |
| 18 | A | B | A | Inv. |
| 19 | C | C | D | Comp. |
| 20 | C | C | D | Comp. |
| 21 | C | C | D | Comp. |
| 22 | A | C | D | Comp. |
| 23 | C | C | A | Comp. |
| 24 | C | A | A | Comp. |

Inv.: Present Invention
Comp.: Comparative Example

As can clearly be seen from Table 2, the porous media of the present invention, which were prepared in such a manner that Water-based Composition B was subjected to coating onto the porous layer formed employing Water-based Composition A comprising urea or its derivatives, minimized the generation of repellency problems, polka dot problems, and deposit problems, compared to comparative examples.

According to the present invention, it is possible to provide a production method of porous media, which minimizes coating problems such as the repellency problem, the polka dot problem, and the deposit problem in the coating process in which at least two coatings are required.

The invention claimed is:

1. A production method of a porous medium comprising a non-water-absorptive support and a porous layer provided on the support, the method comprising:

applying Water-based Composition A comprising inorganic microparticles of an average primary particle diameter of less than or equal to 30 nm, a hydrophilic binder and water onto the support to form a layer, drying the layer to form the porous layer, and applying Water-based Composition B onto the dried porous layer, wherein the Water-based Composition A further comprises a compound represented by formula (1) having a molecular weight of less than or equal to 200, Formula (1)

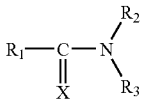

wherein $R_1$, $R_2$ and $R_3$ each represent a hydrogen atom, a substituted or unsubstituted alkyl group, an alkenyl group, an aryl group, an acyl group, a heteroaryl group, a heterocyclic group, —$NR_4R_5$, or —$OR_6$; $R_4$, $R_5$ and $R_6$ each represent a hydrogen atom, a substituted or unsubstituted alkyl group, an alkenyl group, an aryl group, an acyl group, a heteroaryl group, a heterocyclic group, an amino group or a cyano group further, $R_1$ and $R_2$, $R_1$ and $R_3$, and $R_1$ and $R_4$ may be joined together to form a ring; and X represents an oxygen atom or NH, wherein the Water-based Composition B comprises a component which forms coagulants in the Water-based Composition A or increases viscosity of Water-based Composition A, when the component is added in the Water-based Composition A, and the Water-based Composition A does not comprise a component which forms coagulants in the Water-based Composition A or increases viscosity of Water-based Composition A, when the component is added in the Water-based Composition A.

2. The method of claim 1, wherein the compound represented by Formula (1) is soluble in water.

3. The method of claim 1, wherein X is an oxygen atom.

4. The method of claim 1, wherein the compound represented by Formula (1) is urea or its derivative.

5. The method of claim 1, wherein the compound represented by Formula (1) is

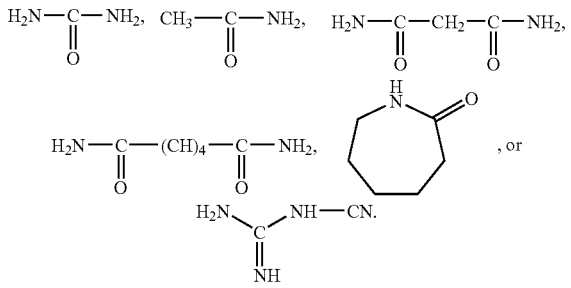

6. The method of claim 1, wherein F/B is 2 to 20, and F is at least 10 g/m$^2$, wherein F is amount of the inorganic microparticles and B is an amount of the binder in the porous layer.

7. The method of claim 1, wherein the method further comprises winding the porous medium into a roll, and the Water-based Composition B is applied onto the porous layer before the winding.

8. The method of claim 1, wherein the component is selected from the group consisting of an organic or inorganic acid, an alkaline additive, a watersoluble salt of watersoluble multivalent metal ion, a surface active agent, an anti-discoloring agent, a cationic fixing agent, and a crosslinking agent of a binder.

9. The method of claim 8, wherein the component is a watersoluble salt of a multivalent metal ion.

10. The method of claim 9 wherein the multivalent metal ion is an aluminum ion, a zirconium ion, or a titanium ion.

11. The method of claim 1, wherein the component is zirconium acetate, polyaluminum oxide, $HOC_2H_4SC_2H_4SC_2H_4OH$, boric acid, polyallylamine, or

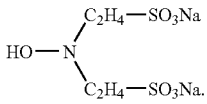

12. The method of claim 1, wherein the Water-based Composition A is applied by a slide bead coating system at viscosity of 5–100 mPa·s.

13. The method of claim 1, wherein the Water-based Composition A coating is applied by a curtain coating system at viscosity of 5–10,200 mPa·s.

14. The method of claim 1, wherein the Waterbased Composition B is applied at viscosity of 1 to 30 mPa·s.

15. The method of claim 1, wherein the Water-based Composition B is applied by a slot nozzle spray apparatus.

16. The method of claim 1, wherein the porous medium is an ink jet recording material.

17. The method of claim 1, wherein $R_4$ and $R_5$ is a hydrogen atom, an alkyl, amino, or cyano group.

18. The method of claim 1, wherein $R_4$ is a hydrogen atom or an alkyl group, $R_5$ is an alkyl group, and $R_1$ is $NR_4R_5$.

19. A production method of a porous medium comprising a nonwater-absorptive support and a porous layer provided on the support, the method comprising, applying Waterbased Composition A comprising inorganic microparticles of an average primary particle diameter of less than or equal to 30 nm, a hydrophilic binder and water onto the support to form a layer, drying the layer to form the porous layer, and applying Water-based Composition B onto the porous layer, wherein the Water-based Composition A further comprises a compound represented by

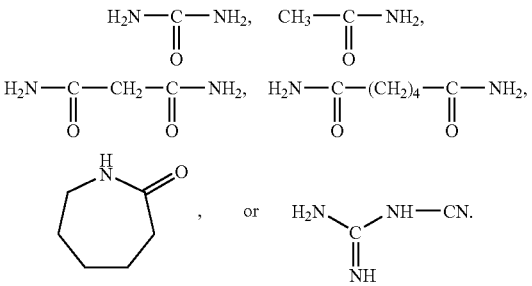

* * * * *